United States Patent [19]

Marti

[11] Patent Number: 4,597,280

[45] Date of Patent: Jul. 1, 1986

[54] HEADPIECE ASSEMBLY

[76] Inventor: Juan P. Marti, Avenida de Roma 89, Manlleu, Barcelona, Spain

[21] Appl. No.: 707,780

[22] Filed: Mar. 4, 1985

[30] Foreign Application Priority Data

Mar. 3, 1984 [ES] Spain ..... 277870[U]

[51] Int. Cl.[4] ..... B21D 11/04

[52] U.S. Cl. ..... 72/315; 413/56

[58] Field of Search ..... 72/313, 312, 315, 314; 413/8, 56

[56] References Cited

U.S. PATENT DOCUMENTS

| | | | |
|---|---|---|---|
| 1,572,376 | 2/1926 | Bingham | 72/315 |
| 1,772,599 | 8/1930 | Dobson | 72/315 |
| 2,840,134 | 6/1958 | Rayburn | 72/315 |
| 2,843,175 | 7/1958 | Black et al. | 72/315 |
| 4,420,283 | 12/1983 | Post | 413/56 |
| 4,439,082 | 3/1984 | King | 413/56 |
| 4,442,693 | 4/1984 | Walter | 413/8 |

*Primary Examiner*—Leon Gilden

*Attorney, Agent, or Firm*—Flynn, Thiel, Boutell & Tanis

[57] ABSTRACT

A headpiece assembly for forming a rolled flange on the border of a collar associated with an annular lid. A sleevelike headpiece is axially slidably supported on a shaft and projects downwardly so as to surround and cooperate with a plurality of clamping levers. The clamping levers at the lower free ends have a clamping part which moves into a radially inward position wherein the clamping part is axially aligned below an annular flange-forming recess, the latter being formed on a pressure plate which is mounted on the lower end of the shaft for limited axial movement therebetween. The pressure plate and the lower free ends of the levers are disposed axially downwardly from the sleevelike headpiece. Downward movement of the headpiece cams the clamping levers radially inwardly to a position below the pressure plate, and causes the headpiece to engage the pressure plate and move it downwardly so as to effect formation of a rounded flange on the metal collar.

7 Claims, 3 Drawing Figures

HEADPIECE ASSEMBLY

This invention relates to a headpiece assembly for forming a rounded flange on an annular lid.

In general, the headpiece assembly is characterized by possessing a headpiece having a vertically descending movement controlled by a pressure fluid. This headpiece, during its descending movement, acts upon clamps which swing inwardly with a circular motion into a position whereby the extreme ends of the clamps, which ends have claws or clamping parts thereon, cooperate with the annular lid in surrounding relationship to the interior collar thereof to assist in holding the lid during the deforming of the collar edge so as to form a rounded flange or bead. The descending movement of the headpiece causes the headpiece to contact protruding arms which are associated with a pressure plate which is then also moved downwardly with the headpiece. This pressure plate, in its base, has an annular recess with a curved concave cross section, which recess is applied to the border of the collar for effectively roll-forming the border during the continued descent of the pressure plate.

The explanation of the headpiece assembly of the invention will be explained in greater detail with reference to an embodiment thereof as presented in the accompanying drawings wherein.

Figure 1:
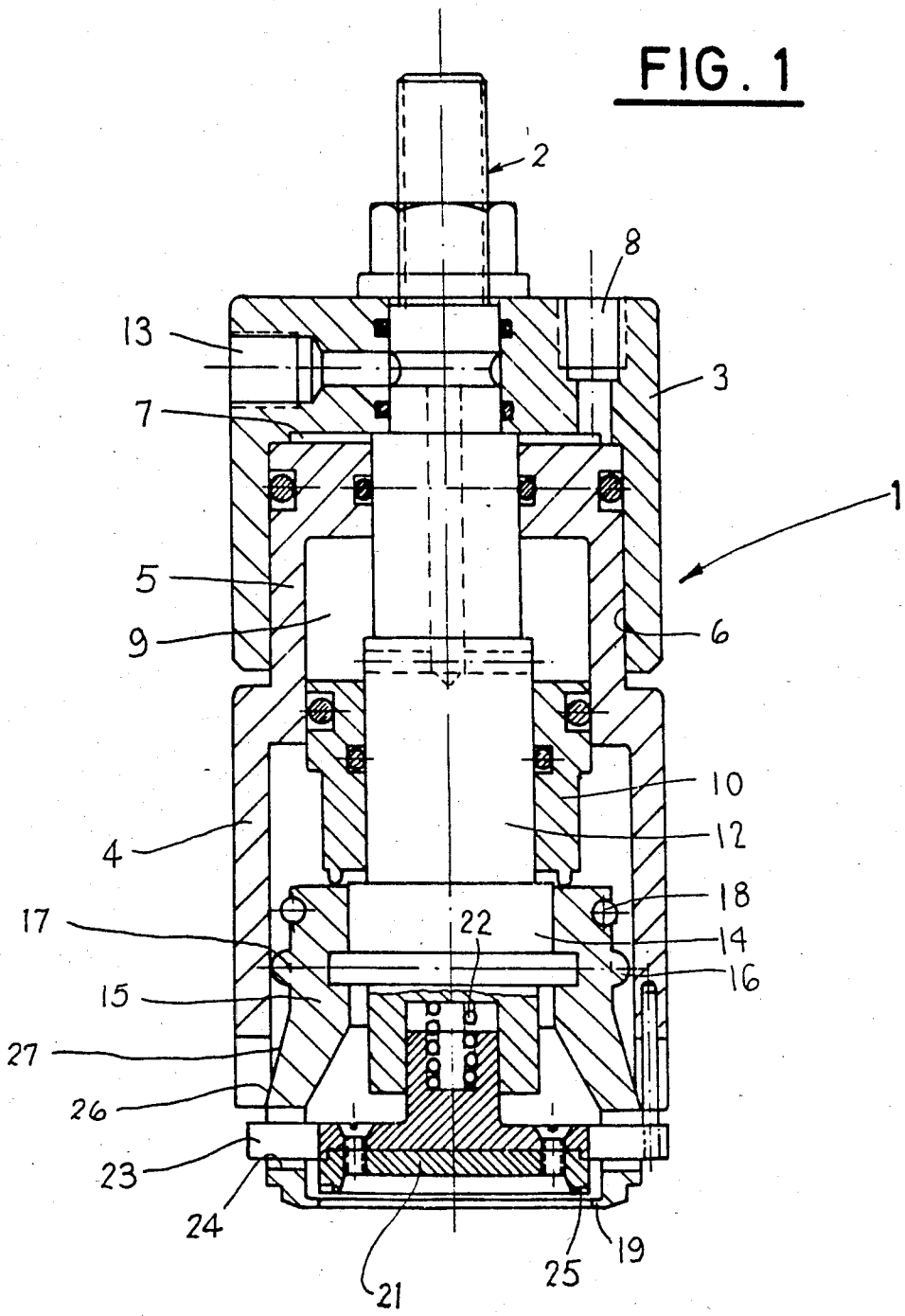
FIG. 1 is a central or diametral elevational sectional view of the headpiece assembly.

As illustrated by FIG. 1, there is generally illustrated a headpiece assembly 1, which assembly can be attached to an overall apparatus adapted for supporting and handling and forming a lid, specifically an annular metallic lid or cover. Reference is made to copending application Ser. No. 569 580 which discloses a lid of this type as associated with a plug. This invention is concerned with the forming of the curved inner flange on the lid.

The assembly 1 includes an elongated and vertically extending stepped shaft 2. A cuplike housing 3 is supported on the shaft 2 adjacent the upper end thereof. A sleevelike headpiece 4 concentrically and slidably surrounds the shaft 2 and is movable axially (that is vertically) relative thereto. This headpiece 4 is formed with a reduced-diameter piston portion 5 at its upper end. This piston portion is sealingly and slidingly received within the bore 6 which opens downwardly from the lower end of the housing 3. Piston portion 5 and housing 3 cooperate to define a pressure chamber 7 therebetween. A suitable pressure fluid such as air or oil is supplied through a port 8 to this chamber 7 when downward extension of the headpiece 4 is desired.

The headpiece 4 also defines a further pressure chamber 9 internally thereof. This pressure chamber 9 is closed at its lower end by a stationary sleeve 11 which creates a sealed relationship with both the headpiece and the shaft. The sleeve 11 is supported on and surrounds the intermediate stepped portion 12 of the shaft. Pressure fluid is supplied to the chamber 9 through a port 13 formed in the housing 3, which port 13 communicates with passages which are formed in and extend axially of the shaft 2 for communication with the chamber 9. Pressurization of chamber 9 permits the headpiece 4 to be raised or returned to its uppermost position upon completion of a forming operation.

The lowermost enlarged portion 14 of the shaft mounts thereon, in surrounding relationship thereto, a plurality of clamping levers 15. These levers are loosely supported with respect to the shaft part 14, as by means of pins projecting from the latter, so that the clamping levers 15 are hence restrained axially relative to the shaft but are free to pivot. For this purpose, each clamping lever 15 has a rounded ball-like enlargement 16 on the outer side thereof which is disposed so as to be close to and substantially bear against the inner wall of the headpiece 4. This enlargement 16 hence enables each clamping lever 15 to effectively pivot substantially about the imaginary axis 16 defined by the enlargement. A suitable elastomeric element 18, such as a ring spring, surrounds the upper ends of the levers 15 so that the levers are normally held in the position illustrated by FIGS. 1 and 2, although the levers can pivot into the position illustrated by FIG. 3.

Each clamping lever 15 projects downwardly from its pivot axis 16 so that the lower free end thereof projects downwardly below the free end of the headpiece 4. The free end of each clamping lever 15 has a claw or holding part 19 formed thereon, which claw 19 projects radially inwardly toward the central vertical axis of the assembly.

The shaft 2 supports, on the lower end thereof, a pressure or forming plate 21, the latter having a hub portion which projects upwardly and is axially slidably received within a bore formed in the lower end of the shaft. This pressure plate 21 is disposed downwardly from the lower free end of the headpiece 4. Pressure plate 21 has a plurality of arms 23 which project radially outwardly thereof through an extent such that the arms 23 are disposed directly vertically below the lower free end of the headpiece 4. These arms 23 project through slots 24 formed through the clamp levers 15 in the vicinity of the free ends thereof. These slots 24 have a vertical extent (that is, in the axial extent of the assembly) which exceeds the thickness of the arms 23 to permit relative motion therebetween.

A spring 22 cooperates between the shaft part 14 and the pressure plate 21 so that the spring normally maintains the pressure plate 21 in a lowered position, in which position the projecting arms 23 are hence disposed adjacent the lowermost limit of the slots 24.

The pressure plate 21 has an annular recess 25 formed on the lower surface thereof, which recess is disposed directly adjacent the outer periphery of the pressure plate 21. This recess 25 has a curved concave cross section which closely resembles a semicircle.

To activate the assembly, and particularly to cause activation of the clamp levers 15, the headpiece 4 is provided with a wedgelike camming surface 26 formed thereon, which camming surface 26 is formed on the inner surface of the headpiece 4 directly adjacent the lower free end thereof. Similar inclined wedgelike camming surfaces 27 are formed on the outer surfaces of the levers 15. Hence, when the headpiece 4 is moved axially downwardly from the position of FIG. 2 toward the position of FIG. 3, the cam surfaces 26 hence slide along the surfaces 27 on the levers 15, and hence cammably swing the levers 15 about the axes 16 so that the lower free ends of the levers swing inwardly into the position illustrated by FIG. 3. This inward swinging of the lower free ends of the levers hence causes the lower free ends of the clamping levers to effectively closely surround and effectively engage the hublike periphery of the pressure plate 21, and in fact this causes the claws 19 on the camming levers to be disposed substantially directly axially aligned with but downwardly from the concave recess 25.

The operation of the headpiece assembly will now be briefly explained to ensure a complete understanding thereof.

Figure 2:
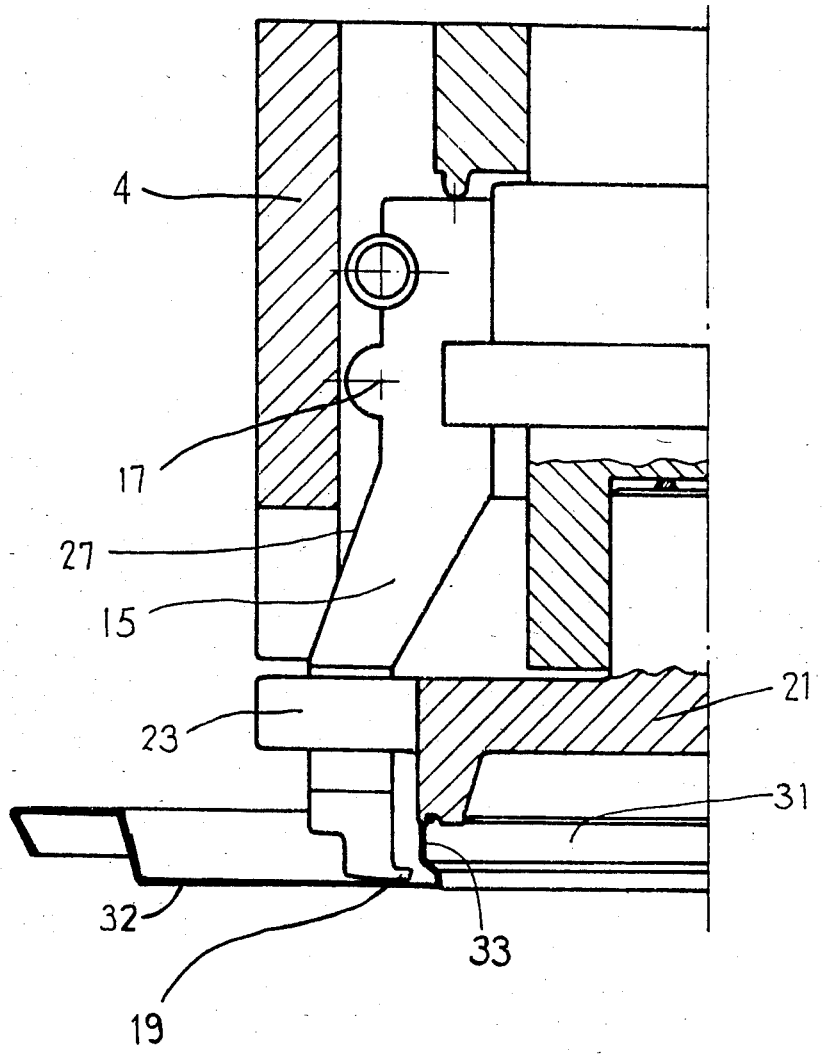
FIG. 2 is an enlarged fragmentary sectional view illustrating the headpiece in its raised position just prior to initiating its downward descent for effecting a roll-forming operation.

A suitable lid 31, such as an annular metallic lid or cover, is initially positioned below the headpiece assembly so that it is substantially coaxially aligned with the pressure plate 21. The cover or lid 31 is already partially preformed and includes a surrounding annular portion 32 having an annular flange or collar 33 projecting axially from the inner edge of the surrounding portion 32. This collar or flange 33 is itself already generally partially preformed as indicated by FIG. 2. This collar 33 is sized so as to be substantially aligned with the forming recess 25 in the pressure plate. Due to relative axial movement between the collar and the headpiece assembly, the free edge of the collar 33 is positioned substantially within the forming recess 25 substantially as illustrated by FIG. 2, and the limited axial pressure between the pressure plate and lid causes the pressure plate 21 to be pushed upwardly against the urging of spring 22, thereby positively seating the free edge of the collar 33 in the forming recess 25.

Thereafter, pressure fluid is supplied to chamber 7 so that the head 4 is extended axially downwardly. During the initial axial extension of the head, the cams 26 react against the wedging surfaces 27 on the levers 15 so that the lower ends of the levers swing inwardly from the position illustrated in FIG. 2 until the claws 19 are disposed substantially directly aligned with the concave recess 25, and the claws are also disposed substantially under the lower end of the flange 33 so that the lid 31 is hence effectively held between the claws and the pressure plate. The claws are held in this radially inward position due to the free ends of the clamping levers effectively engaging the outer periphery of the pressure plate 21, with the clamping levers themselves being held radially inwardly by the surrounding relationship of the headpiece 4.

Figure 3:
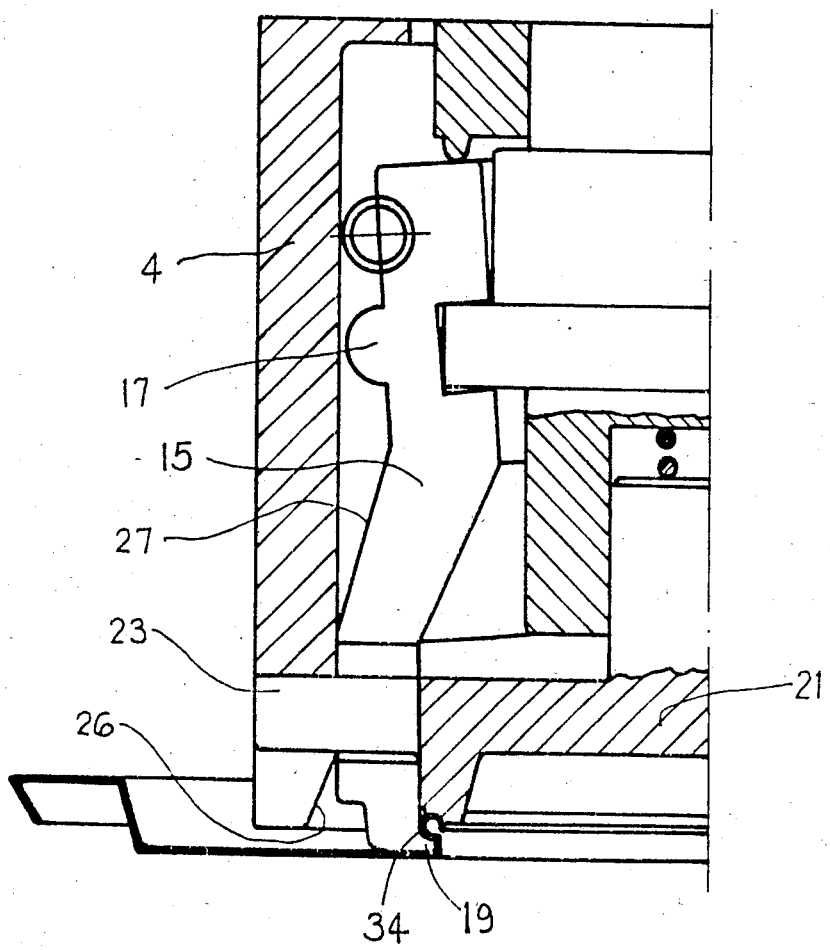
FIG. 3 is a view similar to FIG. 2 but illustrating the headpiece in its lowermost position after having completed the roll-forming operation.

Continued axial downward movement of the headpiece 4 causes the lower free end thereof to engage the radially protruding arms 23 of the pressure plate 21. At this point, the axial downward descent of the headpiece 4 imposes a downward pressure on the pressure plate 21 so that the latter is also moved axially downwardly relative to the levers 15, which movement is permitted by the vertically elongated slots 24. This hence imposes a deforming pressure on the annular collar 33 of the lid so that continued downward movement of the pressure plate causes this collar 33 to effectively be rolled inwardly of the recess 25 and hence effect formation (i.e. crimping) of a bead or rounded flange 34 on the free edge of the collar 33, as illustrated by FIG. 3. This forming of the rounded flange 34 occurs due to the close confinement of the collar 33 within the region defined between the claw 19 and the concave recess 25, which claw 19 and recess 25 axially move toward one another to hence effectively roll-form the flange.

The forming or crimping operation as described above is preferably carried out in association with a plug of plastic material (as shown in Ser. No. 569,580 ) so as to form or crimp the flange 34 around the outer edge of the plug.

After the forming operation has been completed as illustrated by FIG. 3, pressure fluid is then exhausted from the upper chamber 7 and supplied to the lower chamber 9, thereby axially retracting the headpiece assembly back into its original position.

While the above description discloses the spring 22 normally biasing the pressure plate 21 downwardly, in some variations it is preferred to have the spring 22 be a tension spring so as to hence bias the pressure plate 21 upwardly and maintain it in its raised position. In this latter position, the lid will be positioned directly adjacent the pressure plate so that the free edge or border of the collar 33 will hence be positioned in the recess 25. Thereafter, the downward axial descent of the headpiece 4 will cause the above-described downward movement of the pressure plate due to engagement of the headpiece with the protruding arms 23, and thus effect the forming of the rounded flange.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A headpiece assembly for forming a rounded flange, comprising a frame, a headpiece axially slidably supported on the frame for descending axial movement, a pressure plate supported for movement relative to the frame and having an annular forming recess therein for forming the rounded flange, a clamp movably supported adjacent the pressure plate and acted on by the headpiece for movement from a retracted position into a support position, said clamp in the support position having a part therein which is axially aligned directly beneath the forming recess and cooperating therewith to permit forming of the rounded flange, and means cooperating between said headpiece and said pressure plate for effecting movement of the latter toward the clamping part of the clamp when the latter is in its support position.

2. An assembly according to claim 1, wherein the headpiece constitutes a sleeve which concentrically surrounds but is spaced axially upwardly from the pressure plate, the clamp including a plurality of clamping arms disposed in surrounding relationship to the pressure plate within the sleeve, each clamping lever having a protruding part which effectively slidably bears against the interior of the sleeve and which defines an imaginary axis for permitting the clamping lever to pivot substantially within an axial plane which passes through the axis of the sleeve, said sleeve and said clamping levers having opposed inclined surfaces which act as camming surfaces for causing the clamping levers to swing into their support positions as the sleeve moves axially downwardly.

3. An assembly according to claim 2, wherein the pressure plate includes radially projecting arms which project radially outwardly through vertically elongated slots formed in the clamping levers adjacent the free ends thereof, said radially projecting arms being positioned for engagement with the lower free end of the sleeve as the latter moves axially downwardly for imposing downward pressure on the pressure plate to form a rounded flange on the border of a collar held between the pressure plate and the clamping parts of the clamping levers.

4. A headpiece assembly for forming a rounded annular flange on the free border of an annular collar, such as the inner annular collar associated with an annular metallic lid or cover, comprising:

vertically elongated support shaft means defining a central vertical axis;

a headpiece member axially slidably supported on said shaft means, said headpiece member including a sleeve part which concentrically surrounds said shaft means and projects axially downwardly so as to terminate in a lower free end, said sleeve part being spaced radially from said shaft means to define an annular clearance therebetween;

a pressure plate supported on said shaft means adjacent the lower end thereof, said pressure plate being disposed radially downwardly from the lower free end of said sleeve part, and means supporting said pressure plate on said shaft means for limited axial movement therebetween, said pressure plate defining annular flange-forming means on the lower face thereof concentric with said axis;

a plurality of movable clamping levers disposed in surrounding relationship to said pressure plate and substantially within said sleeve part, each said clamping lever including an elongated lever portion which projects axially downwardly and terminates in a lower free end which is positioned axially below said flange-forming means, said lever portion adjacent the free end thereof defining thereon a radially inwardly projecting clamping part, said elongated lever portion being swingable from a radially outward position into a radially inward position wherein the clamping part thereon is substantially disposed directly axially below the flange-forming means on the pressure plate; and camming means cooperating between said sleeve part and said clamping levers in response to downward axial displacement of said headpiece member for effecting swinging movement of said clamping levers from said radially outward to said radially inward position.

5. An assembly according to claim 4, wherein said lever portions include vertically elongated slots projecting radially therethrough, said slots being positioned closely adjacent but spaced upwardly from the lower free ends of said levers, said pressure plate including radially outwardly projecting arms which project into and through said slots so that said arms are disposed axially directly aligned with the lower free end of said sleeve part, said sleeve part during axial descent thereof contacting said arms so as to move said pressure plate downwardly relative to said shaft means to effect the flange-forming operation.

6. A headpiece assembly according to claim 5, wherein said camming means includes inclined surfaces formed on said sleeve part adjacent the lower free end thereof and opposed inclined surfaces formed on said lever portions, said inclined surfaces slidably engaging one another as the sleeve part moves axially downwardly to effect radial inward swinging of the lever portions, said sleeve part when in its lowermost position firmly holding said lever portions in said radially inward position wherein said lever portions are firmly held between said pressure plate and said sleeve part.

7. An assembly according to claim 6, wherein said clamping levers are vertically elongated and are loosely pivotally supported by said shaft means to prevent axial displacement of the clamping levers, each clamping lever having a rounded enlargement on the outer side thereof which effectively slidably bears against the inner surface of the sleeve part, said rounded enlargement defining an imaginary axis about which the clamping lever pivots between the radially outward and radially inward positions, said enlargement being disposed intermediate the upper and lower free ends of the clamping levers, and spring means cooperating with said clamping levers for normally urging the lever portions to swing outwardly into said radially outward position.

* * * * *